US006321671B1

(12) United States Patent
Tomita

(10) Patent No.: US 6,321,671 B1
(45) Date of Patent: Nov. 27, 2001

(54) DISPLAY APPARATUS FOR A SEWING MACHINE

(75) Inventor: Shintaro Tomita, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/597,278

(22) Filed: Jun. 19, 2000

(30) Foreign Application Priority Data

Jun. 21, 1999 (JP) ..... 11-174201

(51) Int. Cl.[7] ..... D05B 21/00; D05C 5/02

(52) U.S. Cl. ..... 112/475.19; 112/102.5; 112/445; 345/667

(58) Field of Search ..... 112/475.19, 470.06, 112/102.5, 445, 470.04; 345/127, 128, 129, 130, 131, 157, 667; 700/138, 136, 137

(56) References Cited

U.S. PATENT DOCUMENTS 4,341,170 * 7/1982 Beckerman et al. ..... 112/445
4,622,907 * 11/1986 Kimura ..... 112/445 X
5,365,254 * 11/1994 Kawamoto ..... 345/131 X
5,740,057 * 4/1998 Futamura ..... 112/470.06 X
5,769,013 6/1998 Morita .
6,082,596 * 3/2000 Hayakawa ..... 112/102.5

FOREIGN PATENT DOCUMENTS 5-49770 3/1993 (JP) .
A-10-137468 5/1998 (JP) .

* cited by examiner

*Primary Examiner*—Peter Nerbun
(74) *Attorney, Agent, or Firm*—Oliff & Berridge, PLC

(57) ABSTRACT

In a display apparatus used for a sewing machine, a liquid crystal display, LCD, shows a pattern edit screen in which a pattern is edited. The pattern edit screen has a standard display area for displaying the pattern for editing. The standard display area has a vertical long rectangular shape and is smaller than a half of the screen. When the image key is pressed on the pattern edit screen, the LCD is switched from the standard display area to a magnification display area, and the pattern is magnified and displayed thereon. The magnification display area is substantially as large as the whole of the display area of the LCD. Thus, the pattern can be displayed in greater detail. Furthermore, shading can be added to the pattern displayed. Therefore, each piece of thread can be presented, which makes the image of the formed pattern more realistic.

30 Claims, 10 Drawing Sheets

DISPLAY APPARATUS FOR A SEWING MACHINE

BACKGROUND OF THE INVENTION

1. Field of Invention

The invention relates to a display apparatus for a sewing machine, in which a pattern can be edited via a pattern edit screen, and to a display apparatus that can display the pattern with high resolution.

2. Description of Related Art

In a conventional electronically controlled sewing machine capable of embroidering the ROM (nonvolatile memory) stores pieces of pattern data related to utility stitch patterns such as straight and zigzag, character patterns such as letters and numerals, and embroidery patterns such as a symbol, for example, an animal or a flower. Patterns are shown on the display, and a desired one is searched over screens and selected thereon. For embroidery patterns edit processes, such as changing the sewing position of the pattern relative to an embroidery frame holding a material according to necessity, enlarging, reducing, and rotating the image of pattern, are performed via the pattern selection screen.

For example, a sewing data process device disclosed in the specification of U.S. Pat. No. 5,769,013, has a pattern editing screen, which is used for editing, including a layout display. The pattern editing screen comprises a pattern display area in which a pattern to be sewn is displayed on the left, and function keys acting as touch keys placed on the right of the pattern display area such as move keys to move a pattern in each of eight directions, a zoom in key to magnify the pattern, and a zoom out key to reduce the display of the pattern. Various editing processes can be made on an embroidery pattern displayed on the pattern editing screen.

A sewing pattern display device disclosed in Japanese Laid-Open Patent Publication No. 10-137468, has a liquid crystal display equipped with a control panel. A selected pattern is displayed on the layout area displayed on the display. Based on the magnification/reduction ratio set in the magnification/reduction input device provided on the control panel, only a specified portion of the pattern can be partially magnified or reduced on the display.

As mentioned above, in the sewing data process device described in the specification of U.S. Pat. No. 5,769,013, embroidery patterns are edited through the use of a plurality of function keys. Therefore, the function keys are larger than the pattern display area for ease of use.

The size of the pattern display area is necessarily reduced by more than half of the screen. Accordingly, the magnification ratio can not be increased to magnify the display of the whole of the pattern, and the resolution to display the pattern in the pattern display area can not be raised.

Similarly, when the realistic image of the embroidery pattern found from the sewing data is displayed in the pattern display area, the image display area for editing can not be enlarged, and it is impossible to display images of stitches in detail. If a large-sized display is provided, the pattern display area can be enlarged. However, it leads to not only upsizing of the sewing machine but also raising of the manufacturing cost.

In the sewing pattern display device described in Japanese Laid-Open Patent Publication No. 10-137468, the layout screen is split in nine parts (three rows×three lines) based on the size of the embroidery frame, and only a specified split part is magnified to fill the layout screen. Although the size of the layout screen is unchanged, the size of the split part can be reduced to increase the magnification ratio, thereby seeing the split part as a larger view. However, this magnification is limited only to the split part and the entire pattern can not be magnified.

SUMMARY OF THE INVENTION

The invention provides a display apparatus for a sewing machine, having a display device for displaying a magnified image of a pattern as large as possible by making the use of whole display area of the display device. Also, the invention provides a display apparatus, which can achieve higher resolutions when displaying an image of a pattern for editing. Further, the invention provides a display apparatus, which can display the pattern image realistically.

In this regard, the display apparatus for a sewing machine of the invention may include a display device that displays a pattern on a display area thereof, a display controller that controls the display device to selectively display a first display screen for displaying a pattern and a second display screen for displaying a magnified image of the pattern, the second display screen being larger than the first display screen, and a display switching device that switches the display on the display device between the first display screen and the second display screen.

According to the sewing machine structured as described above, the first display screen displays the pattern in normal size for editing, such as a layout, of the pattern. When the display switching device switches the display on the display device from the first display screen to the second display screen, the second display screen displays the magnified image of the pattern. As the second display screen is larger than the first display screen, a user can easily confirm the pattern in detail by looking at the magnified image of the pattern on the second display screen.

In an exemplary embodiment of the invention, the first display screen may be less than half of the whole display area. Therefore, the display area excluding the first display screen can display all of the information required for editing the pattern.

In another exemplary embodiment of the invention, the second display screen may be approximately as large as the whole display area. Therefore, the second display screen can display the pattern while magnifying the pattern as large as possible using substantially the whole display area.

In another exemplary embodiment of the invention, the display device may include a touch key panel and the display controller controls the display device to display at least one function key thereon. Therefore, the user can edit the pattern easily using the function keys displayed on the display device.

In another exemplary embodiment of the invention, the first display screen may include a predetermined number of function keys, and the second display screen may include less than the predetermined number of function keys. Therefore, when the display is switched to the second display screen, the second display screen can become as large as possible by eliminating the number of the function keys to be displayed on the display area because some of the function keys are not used while displaying the magnified image of the pattern. On the other hand, in the first display screen, the full set of function keys is available for editing the pattern.

In another exemplary embodiment of the invention, when the display on the display device is switched to the second display screen, at least one key is displayed on the display area except the second display screen. Therefore, the display can be switched from the second display screen to the first display screen at any time while the second display screen is displayed.

In another exemplary embodiment of the invention, the first display screen may be placed in a first orientation, the display area and the second display screen may be placed in a second orientation perpendicular to the first orientation, and when the display is switched between the first display screen and the second display screen, the pattern may be rotated 90°. Further, the first orientation may be a portrait orientation and the second orientation may be a landscape orientation. Therefore, the pattern, such as a train or a car, can be displayed in a portrait orientation in the first display screen. When the display is switched from the first display screen to the second display screen by the display switching device, the pattern is rotated 90° and displayed in a landscape orientation in the second display screen. Namely, as the pattern is displayed in appropriate orientation, it is possible to magnify the whole of the pattern through the effective use of the display area.

In another exemplary embodiment of the invention, the display apparatus may further include a display data creating device that creates display data based on sewing data. And the second display screen displays the magnified image of the pattern according to the display data created by the display data creating device. Therefore, as the magnified image of the pattern can be displayed in high resolution, the pattern can be displayed in detail and more realistically.

In another exemplary embodiment of the invention, the display device may include a color display device. Therefore, the display device can display the image of the pattern in color in greater detail. In addition, the image can be put in the shadings using black, so that the pattern can be displayed realistically as close as the actual formed pattern.

BRIEF DESCRIPTION OF THE DRAWINGS

Various exemplary embodiments of the invention will be described in greater detail with reference to the accompanying drawings wherein.

DETAILED DESCRIPTION OF PREFERRED EMBODIMENTS

Various exemplary embodiments of the invention will be described in detail with reference to the accompanying drawings. The various exemplary embodiments of the invention will be described embodied in an electronically controlled sewing machine having an embroidering device that enables embroidery of various patterns. Although the invention is described as embodied in an electronically controlled sewing machine having an embroidering device, it should be appreciated that the invention is applicable to an electronically controlled sewing machine having a pattern sewing or forming device that forms a pattern, for example, a button hole, using, for example, a utility stitch or a zig-zag stitch.

Figure 1:
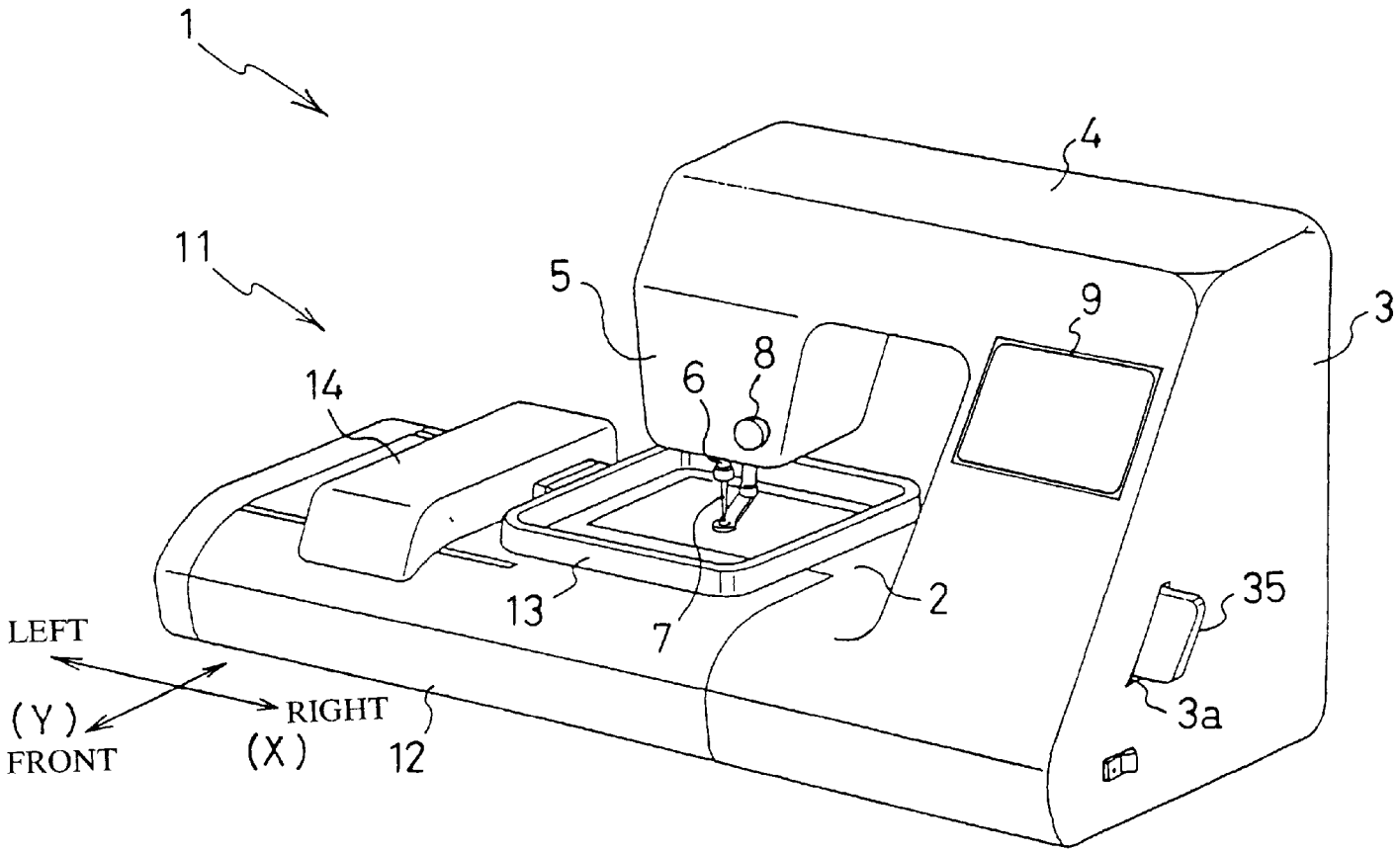
FIG. 1 is a perspective view of an exemplary embodiment of an electronically controlled sewing machine according to the invention.

As shown in FIG. 1, an electronically controlled sewing machine 1 has a bed 2, a standard portion 3 that stands on the bed 2, an arm 4 extending from the upper part of the standard portion 3 so as to face the bed 1. The bed 2 includes a feed dog up and down moving mechanism (not shown) that moves a feed dog up and down, a feed dog back and forth moving mechanism (not shown) that moves the feed dog back and forth, and a thread loop taker (e.g. a vertical axis oscillating shuttle) that contains a lower thread bobbin and incorporates with a needle 7. On the side of the standard portion 3, there is a slot 3*a* in which a memory card 35, for example a ROM card, having a large amount of pattern data (sewing data and pattern display data), which can be added optionally, is connected to an internal connector 27 (refer to FIG. 2).

The arm 4 includes a needle bar driving mechanism (not shown) that moves a needle bar 6 having the needle 7 at the bottom up and down, a needle bar swinging mechanism (not shown) that swings the needle bar 6 in the direction perpendicular to a feed direction of a work cloth, and a thread take-up driving mechanism (not shown) that moves a thread take-up in accordance with the up and down movement of the needle bar 6.

The feed dog up and down moving mechanism, the needle bar driving mechanism, and the thread take-up driving mechanism are driven by a machine motor 31. The needle bar swinging mechanism is driven by a stepping motor 32 for swinging the needle bar. The feed dog back and forth driving mechanism is driven by a stepping motor 33 for moving the feed dog back and forth (refer to FIG. 2).

A machine head 5 in the arm 4 has a start/stop button 8 for a start/stop switch 8*a* that orders a start and end of sewing operation. A display 9, for example, a color liquid crystal display (LCD) is provided in front of the arm 4. The LCD 9 displays stitch types, pattern names, function names, and various messages assigned in utility stitch patterns and embroidery patterns. The LCD 9 has a plurality of touch keys 10, which are strips of transparent electrodes placed thereon lengthwise and laterally, corresponding to indication positions of a plurality of patterns and function keys. Thus, selection of a desired pattern or an order of a function can be realized simply by pressing a corresponding touch key 10.

On the left end of the bed 2, a free bed, generally known as a free arm, is formed. An embroidery frame driving mechanism (embroidery device) 11 that moves an embroidery frame 13, or other work holder, is detachably fixed to the free bed.

The embroidery frame driving mechanism 11 has a casing 12, the embroidery frame 13 that holds a work cloth detachably, a cover 14 having a Y direction driving mechanism that moves the embroidery frame 13 in the Y direction (backward and forward), and an X direction driving mechanism, included in the casing 12, that moves the cover 14 and the Y direction driving mechanism in the X direction (leftward and rightward). The X direction driving mechanism is driven by an X direction driving motor 15, and the Y direction driving mechanism is driven by a Y direction driving motor 16 (FIG. 2).

The motors 15 and 16 may be stepping motors. When the frame driving mechanism 11 is attached to the free bed, the motors 15 and 16 are electronically connected to a controller 20 of the sewing machine 1 via a connector 28, and status whether the frame driving mechanism 11 is attached is detected. In addition, the controller 20 controls and drives the motors 15 and 16, to move the embroidery frame 13, in which a work cloth is set, in the X- and Y-axis directions individually (corresponding to two directions intersecting at right angles) to perform an embroidering operation.

Next, a control system of the sewing machine 1 will be described.

Figure 2:
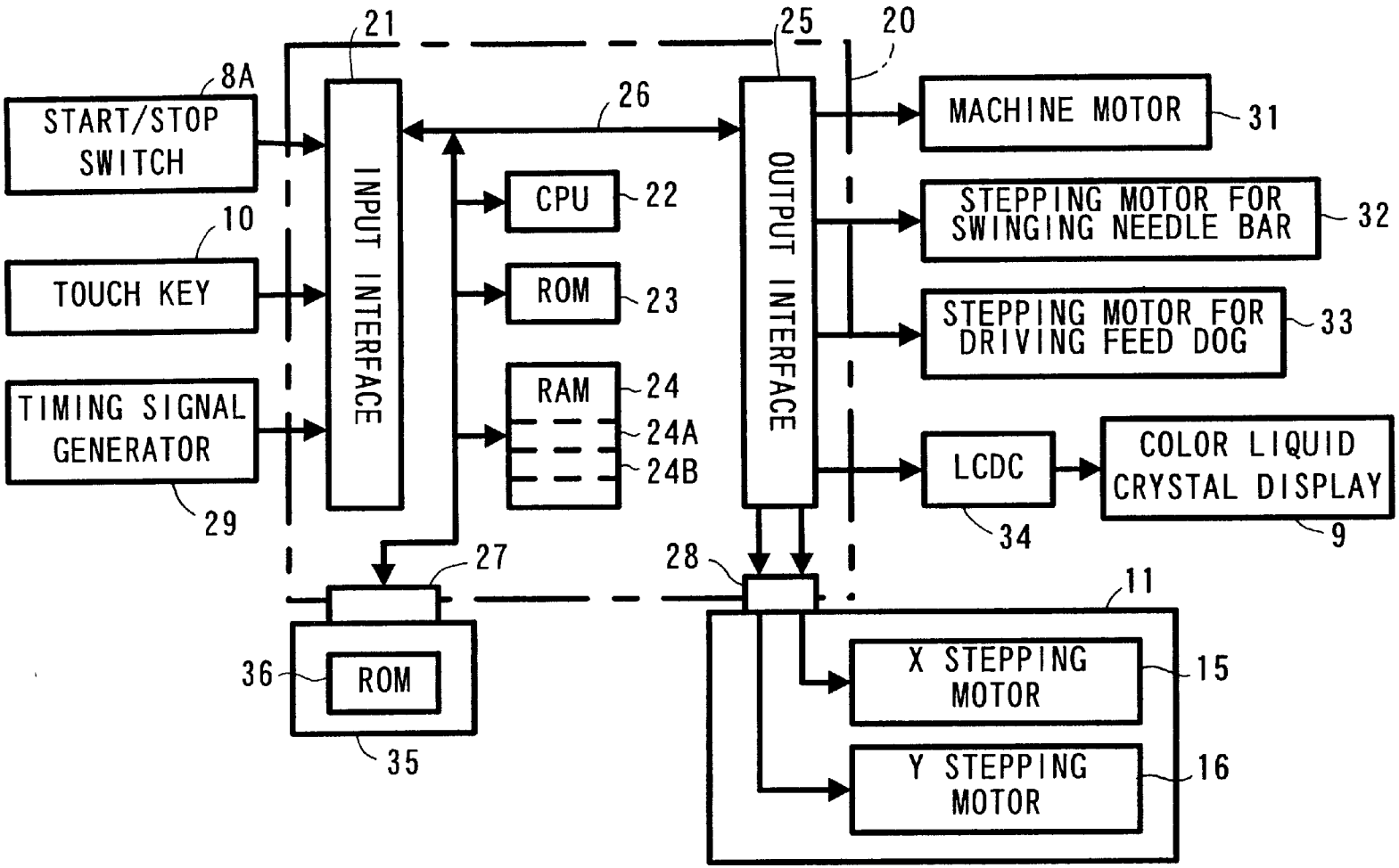
FIG. 2 is a block diagram of an exemplary embodiment of a control system of the sewing machine according to the invention.

As shown in FIG. 2, the controller 20 has an input interface 21, a CPU 22, a ROM 23, a RAM 24, an output interface 25, and a bus 26 that serves to connect each other. The input interface 21 is connected to the start/stop switch 8*a*, the touch keys 10, and a timing signal generator 29 that detects a plurality of rotating phases of the sewing machine main shaft.

The output interface 25 is connected to the machine motor 31, the stepping motor 32 for oscillating the needle bar, the stepping motor 33 for driving the feed dog, a display controller (LCDC) 34 for the LCD 9, and the connector 28 that is connected to the X driving motor 15 and the Y driving motor 16 of the frame driving mechanism 11. The ROM 36 of the ROM card 35 is connected to the bus 26 via the connector 27.

The ROM 23 pre-stores a control program required for selecting a utility stitch pattern and an embroidery pattern, a drive control program required for driving motors 31 to 33 and 15 and 16 to perform embroidering of a selected pattern, a display control program, and an edit control program for editing a selected pattern via the LCD 9, such as displaying an image created based on the sewing data of the pattern and changing sewing position.

Figure 3:
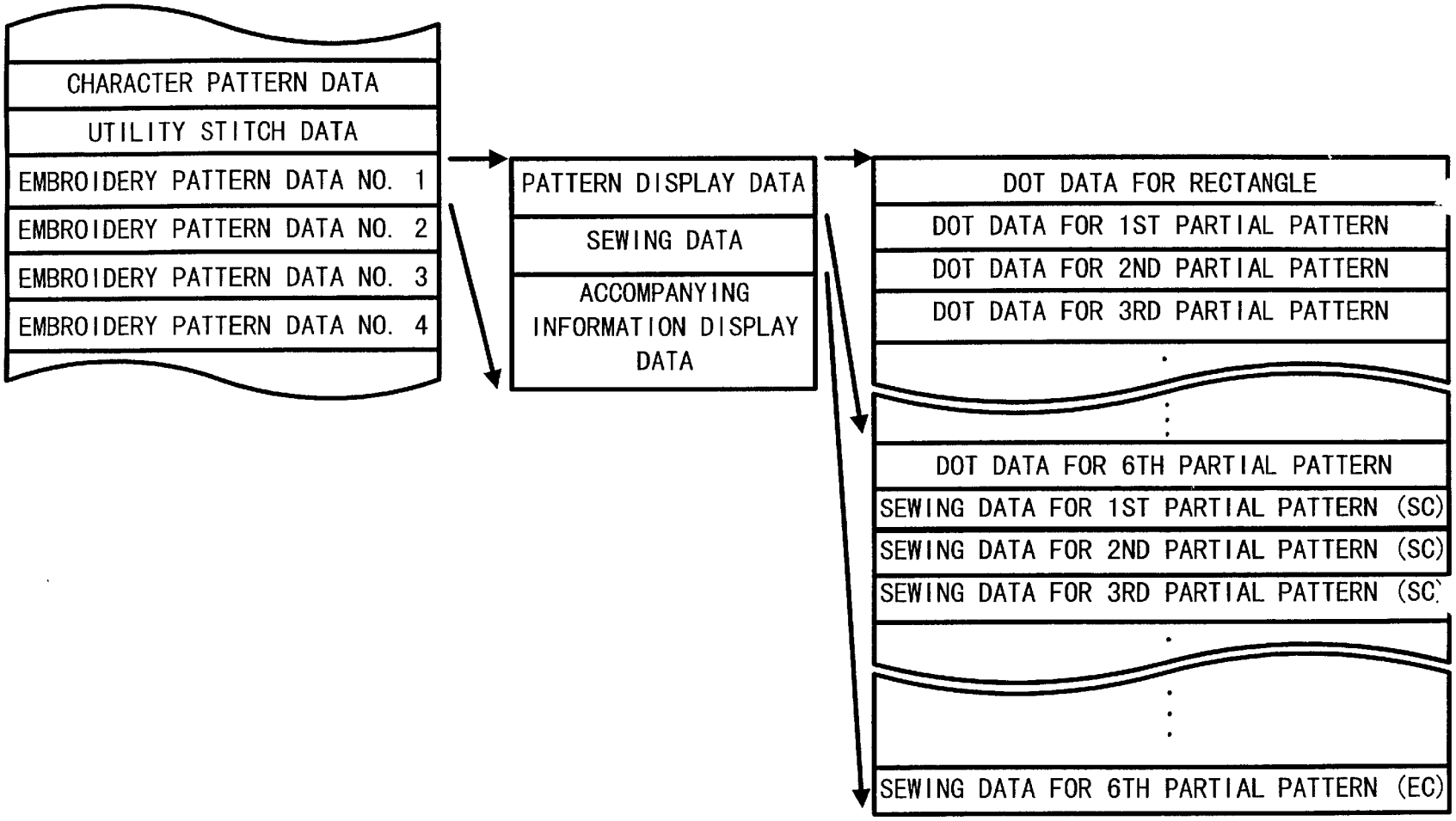
FIG. 3 is an exemplary embodiment of a structure of data stored in a pattern data memory.

The pattern data memory 23*a* of the ROM 23, stores as shown in FIG. 3, the following data types: character pattern data related to letters, symbols and numerals, which comprises display data and sewing data; utility stitch pattern data including straight and zigzag stitches, which comprises display data and sewing data; and embroidery pattern data which is often used relatively and divided into groups designated with numbers (for example embroidery pattern No.1, embroidery pattern No. 2, and embroidery pattern No. 3).

As embroidery pattern data has the same composition, the data for embroidery pattern No. 1 is taken as an example. As shown in FIG. 3, embroidery pattern No.1 comprises pattern display data, sewing data, and accompanying information display data. The pattern display data is used to display the whole of the pattern and its partial patterns with different colors; the sewing data is required to perform embroidering; and the accompanying information display pattern data is used to display related information on each screen for pattern selection control and edit control. All data is stored distinctively.

Figure 8:
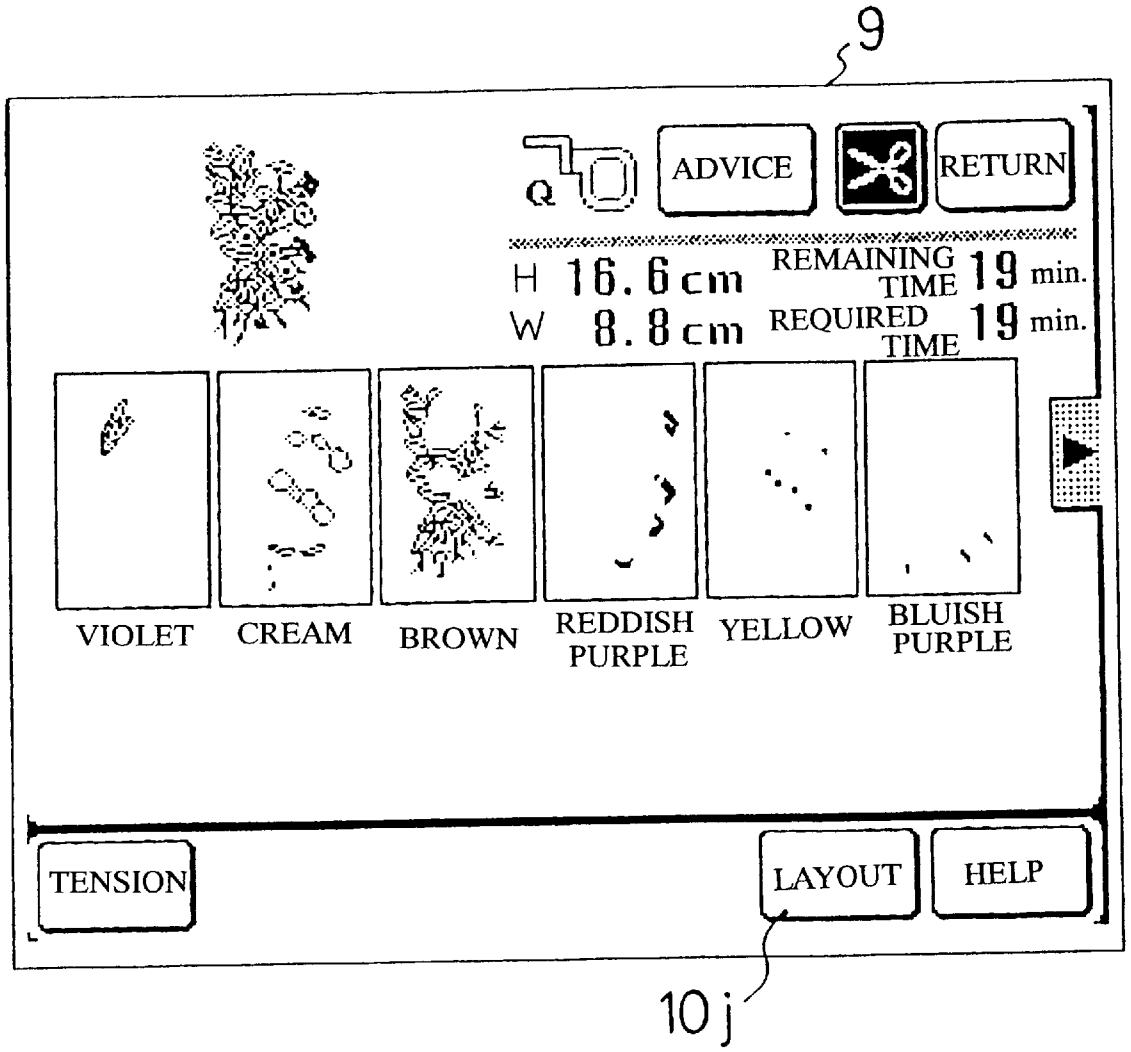
FIG. 8 is an exemplary embodiment of a pattern confirmation screen.

For example, a floral pattern shown in FIG. 8, which is embroidered with six different colors, is set as embroidery pattern No. 1. The floral pattern comprises six partial patterns. To display the six partial patterns surrounded by rectangles on the LCD 9, bitmap data for each of six partial patterns and the rectangles are stored as the display data of the floral pattern.

As sewing data, the floral pattern has six pieces of sewing data for six partial patterns, each of which is sewn with one of the six different colors. The sewing data for each partial pattern has a plurality of stitch points, a stop code (SC) for thread change, and a sewing time. The sewing data for the last partial pattern includes an end code (EC) instead of SC.

As accompanying information display data, the floral pattern includes the display data to display messages and function names related to screens in various cases.

The ROM card 35 has a plurality of versions according to the embroidery pattern type. As with the ROM 23, the ROM 35 of the ROM card 36 stores various kinds of embroidery pattern data categorized and designated with numbers, from popular patterns such as animals, vehicles, and flowers, to special patterns such as different figures, symbols, and characters (a person, animal or robot represented in a film or TV program).

The RAM 24 includes a sewing data memory 24*a* that stores sewing data for embroidery patterns to be embroidered, an image display data memory 24*b* that stores image display data created for displaying an image on the LCD 9, and memories required for each control described above (e.g., pointer memory, counter memory, register, buffer).

Figure 4:
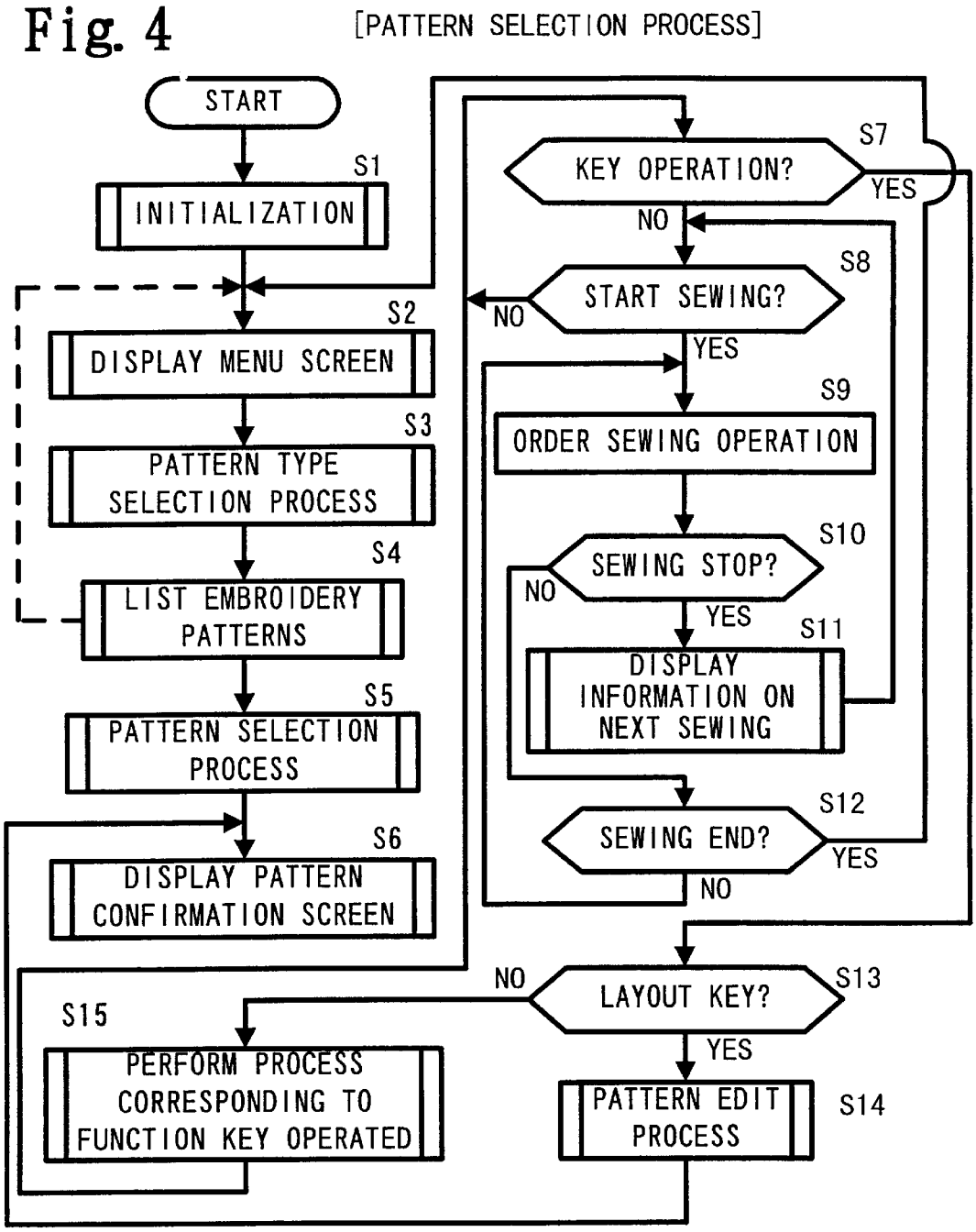
FIG. 4 is a flowchart of an exemplary embodiment of a pattern selection process.
Figure 5:
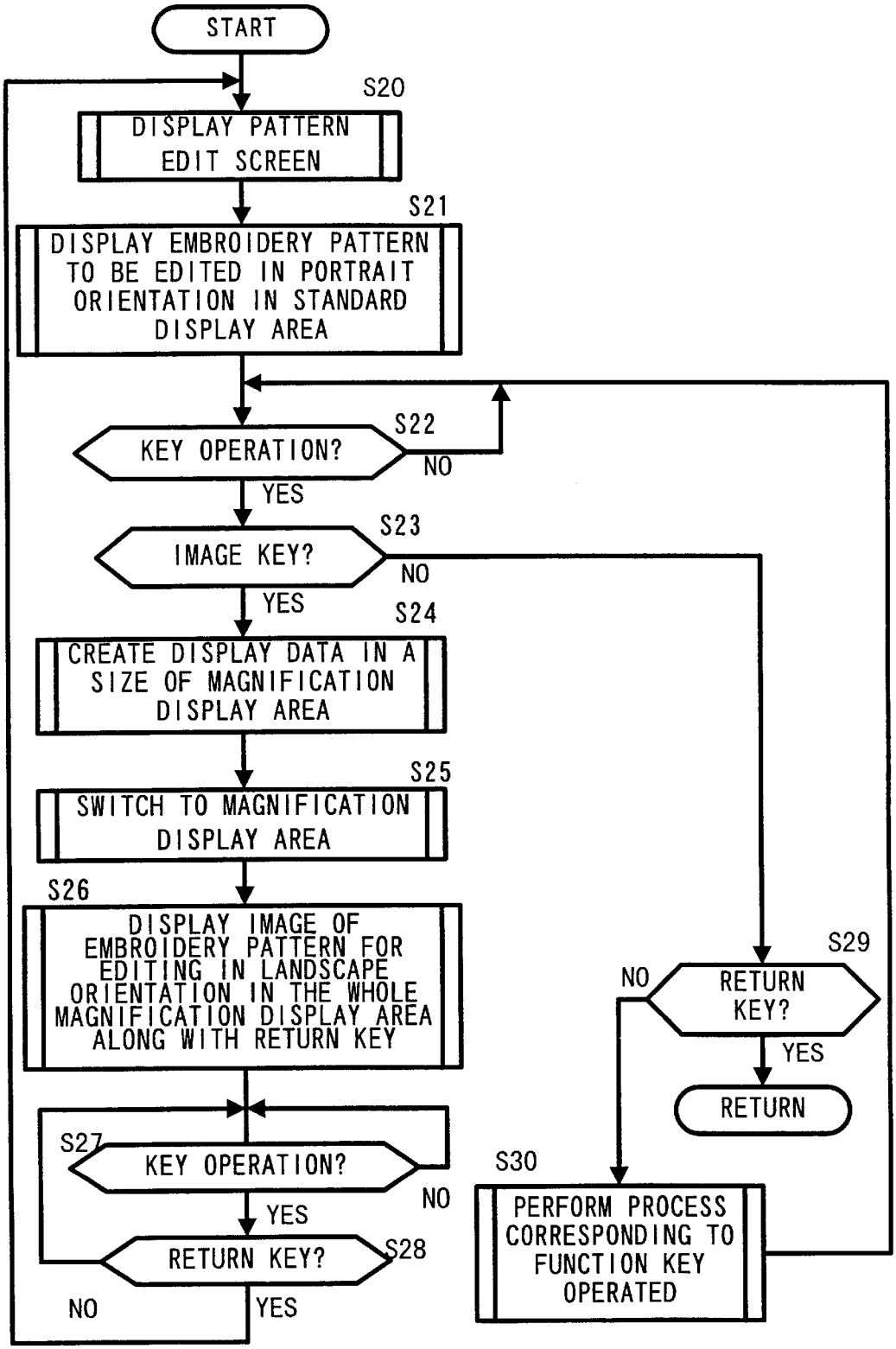
FIG. 5 is a flowchart of an exemplary embodiment of a pattern edit process.

Next is an explanation about routines regarding the pattern selection process executed in the controller 20 with reference to the flowcharts of FIGS. 4 and 5. In the flowcharts, Si (i=1, 2, . . . ) stands for a procedure step.

Figure 6:
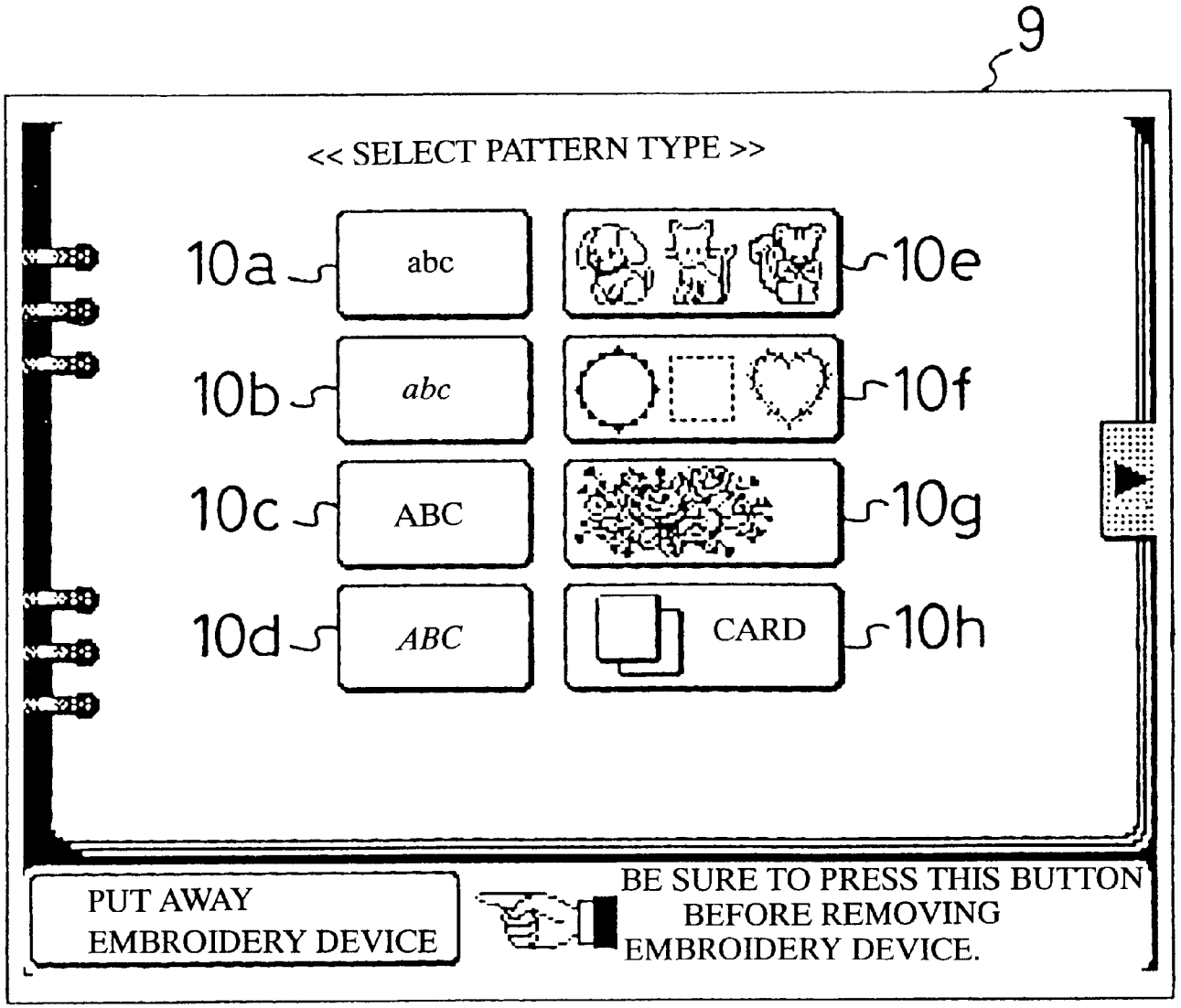
FIG. 6 is an exemplary embodiment of a menu screen.

When the power is turned on and the pattern selection process is started, initialization, such as clearing each memory in the RAM 24 and resetting the frame driving mechanism 11, is performed (S1). A menu screen where a pattern type is specified appears on the LCD 9 (S2). As shown in FIG. 6, the LCD 9 displays the menu screen having character specifying keys 10*a*, 10*b*, 10*c*, and 10*d* used for specifying fonts of characters and letters, symbol keys 10*e*, 10*f*, and 10*g* for selecting symbol patterns, and a card key 10*h* for selecting an embroidery pattern stored in the ROM card 35 inserted into the machine.

Figure 7:
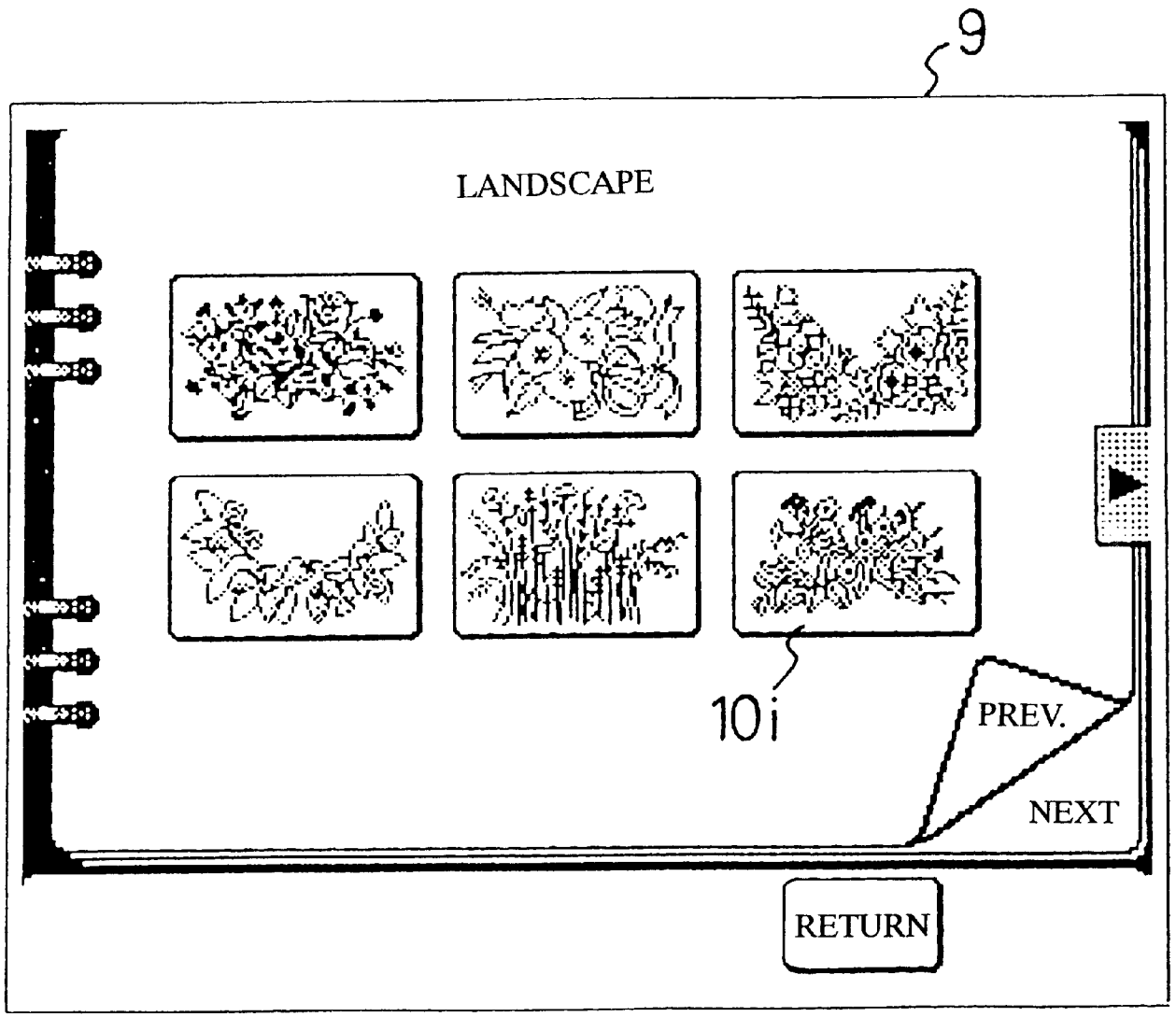
FIG. 7 is an exemplary embodiment of a list of embroidery patterns.

When a desired pattern type is selected from the menu screen with the touch key 10 (S3), patterns categorized in the selected pattern type are listed (S4). For example, when the floral pattern type is selected from the menu screen with the symbol key 10*g*, first six floral patterns included on the first page of the type are listed in landscape orientation, as shown in FIG. 7. If the return key is pressed at this time, the procedure returns to S2 to display the menu screen. When a pattern is selected from a list of patterns (S5), a pattern confirmation screen showing the selected pattern and its partial patterns for indicating different colors is displayed (S6).

For example, when the list of patterns is displayed as shown in FIG. 7 and a floral pattern is selected with the touch of the pattern key 10*i* on the LCD 9, the pattern confirmation screen showing the floral pattern and its partial patterns for indicating different colors is displayed as shown in FIG. 8. After that, when there is no key operation (S7: No) and the start/stop button 8 is pressed to activate the start/stop switch 8*a* to start embroidering process (S8: Yes), the start of the embroidering process is ordered (S9). As a result, each single stitch data is successively read from the sewing data memory 24*a,* and the embroidering process is performed (S9, S10: No, S12: No). If embroidering is temporarily suspended because of stop code SC for a thread color change (S10: Yes), the LCD 9 displays the sewing information on the next color such as "second (third) color is to be embroidered" (S11).

If a thread is broken or embroidering is suspended because of the operation of the start/stop button 8, the embroidering operation is just stopped temporarily. When embroidering of all partial patterns is completed (S10: No, S12: Yes), steps on and after S2 are repeatedly performed.

If any function key other than the layout key 10*j* is pressed on the pattern confirmation screen shown in FIG. 8 (S7: Yes, S13: No), a process corresponding to the key pressed is performed (S15). If the layout key 10*j* is pressed (S7: Yes, S13: Yes), the pattern edit process (FIG. 5) is executed (S14).

Figure 9:
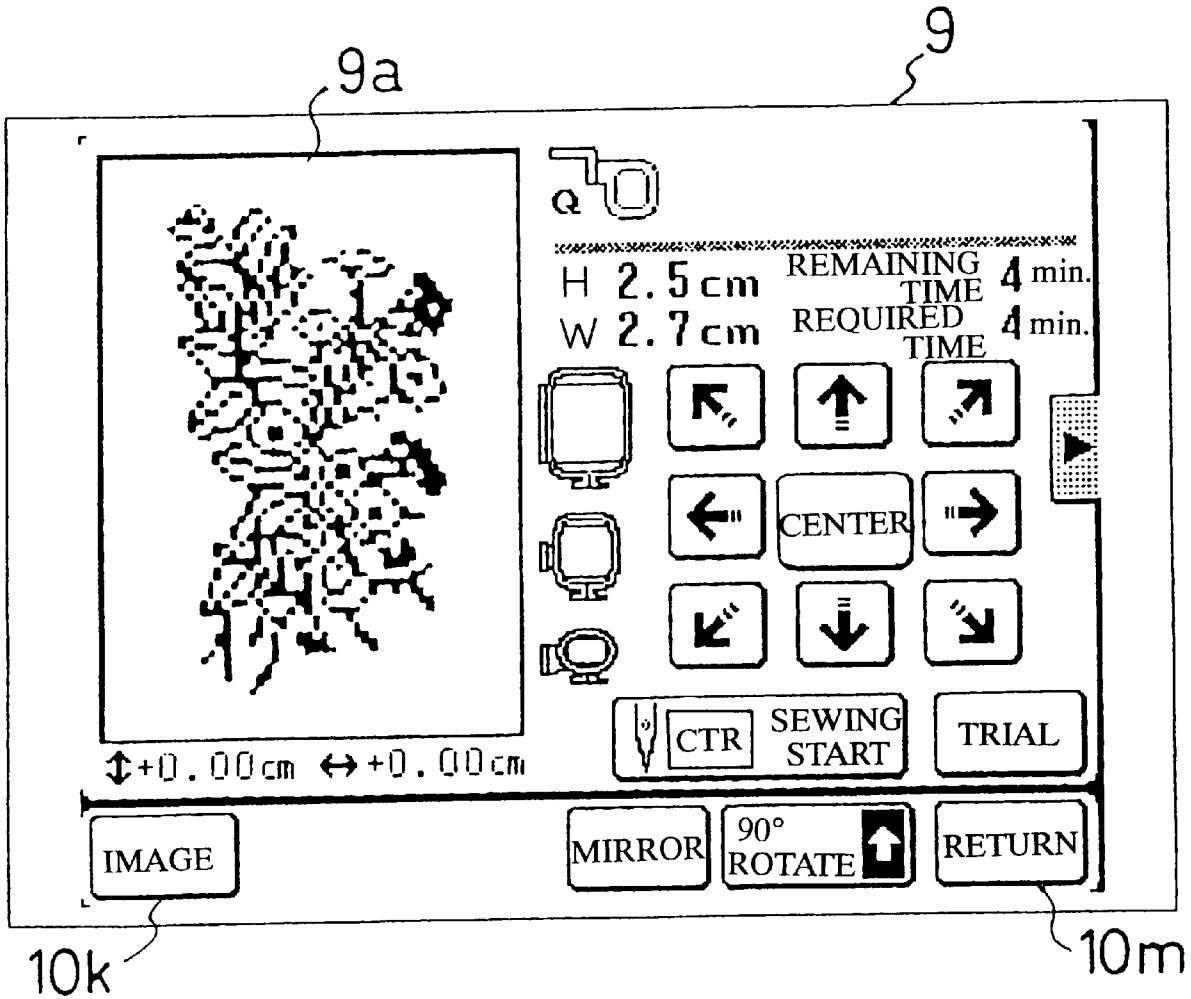
FIG. 9 is of an exemplary embodiment of a pattern edit screen having a standard display area.

When this process is started, the pattern edit screen appears (S20). As shown in FIG. 9, the pattern edit screen has a rectangular shape in the landscape orientation, which substantially fills the whole LCD 9. The pattern edit screen has a standard display area 9*a* placed in the portrait orientation on the left in a size smaller than a half of the screen. The standard display area 9*a* represents an area where embroidering is available. On the right of the standard display area 9*a,* there are edit function keys such as the eight-direction move keys to scroll the pattern for editing in the standard display area 9*a,* the needle position specifying keys (the center key and sewing start key), the trial key, and the image key 10*k.* The pattern edit screen further displays the size of the pattern (in height and width), the embroidering time, and the remaining time.

Then, the embroidery pattern for editing is vertically displayed in colors in the display area 9*a* based on the display data created from the sewing data (S21). In FIG. 9, the floral pattern, which is selected using the pattern key 10*i* of FIG. 7, is placed substantially in the center of the display area 9*a* in the portrait orientation. Any of the move keys is pressed, so that the floral pattern can be scrolled in the direction indicated on the key pressed. Although in the embodiment, the display area 9*a* is capable of editing embroidery patterns such as scrolling a pattern, this may be just used for confirming the layout of the pattern.

When the image key 10*k* is pressed to magnify the floral pattern and display its enlarged image (S22: Yes, S23: Yes), the image display data for the floral pattern is created based on the sewing data so that it is displayed on a magnification display area 9*b* which fills the subtotal area of the LCD 9 (S24).

Figure 10:
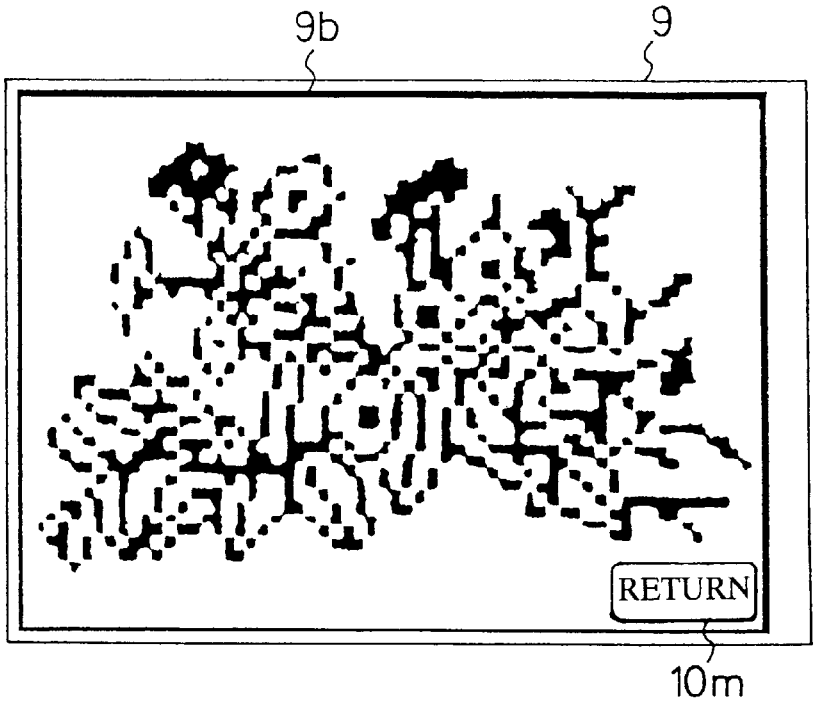
FIG. 10 corresponds to FIG. 9 when the display is changed to a magnification display.

The standard display area 9*a* is switched to the magnification display area 9*b,* which is displayed on the subtotal area of the LCD 9 (S25). Based on the display data created at S24, the embroidery pattern for editing is rotated 90° and horizontally displayed nearly in the center of the magnification display area 9*b* equipped with the return key 10*m* (S26). In FIG. 10, the LCD 9 displays the magnification area 9*b,* which has been switched from the standard display area 9*a.* The image of the floral pattern is magnified and displayed in the magnification area 9*b* in the landscape orientation. At this time, the return key 10*m* is displayed in an area which has little effect on the image (in a lower right area in this case).

The magnification display area 9*b* is more than twice as large as the standard display area 9*a.* Because the image data for the floral pattern is created based on the sewing data, the image of the whole floral pattern is displayed as large as possible without deteriorating the resolution. Furthermore, shading can be added to the image with black color, so that the pattern can be displayed realistically as in the case of the actual embroidered pattern. When the return key 10*m* is pressed (S27: Yes, S28: Yes), the procedure returns to S20, and the former pattern edit screen (FIG. 9) appears at S20 and S21.

At this time, the magnification display area 9*b* is switched to the standard display area 9*a* having function keys for editing which are not displayed in the magnification display area 9*b.* On the pattern edit screen, when a function key except for the image key 10*k* and the return key 10*m* is operated (S22: Yes, S23: No, S29:No), a process corresponding to the function key operated is done (S30). If the return key 10*m* is operated (S22: Yes, S23: No, S29: Yes), this process is finished, the procedure returns to S6 of the pattern selection process, and the pattern confirmation screen of FIG. 8 reappears.

As mentioned above, when the layout key 10*j* is operated on the pattern confirmation screen, the pattern edit screen appears. The pattern edit screen includes the standard display area 9*a* on the left, which is a vertical rectangular area showing embroidering is possible. The standard display area 9*a* displays an embroidery pattern for editing. When the image key 10*k* is operated, the standard display area 9*a* is switched to the magnification display area 9*b.* Accordingly, the image of the pattern displayed in the standard area 9*a* is magnified and displayed in the magnification display area 9*b* in greater detail. In addition, shading can be added to the image with black color, so that embroidery pattern can be displayed realistically as close as the actual embroidered pattern.

When the standard display area 9*a* is switched to the magnification display area 9*b,* the number of function keys, such as the move keys, is decreased. On the contrary, when the magnification display area 9*b* is switched to the standard display area 9*a,* the number of the function keys is increased. When the image of the embroidery pattern is displayed in the magnification display area 9*b,* the function keys, such as the move keys, are not needed. Therefore, the number of function keys can be decreased. The magnification display area 9*b* can be expanded as long as the number of the function keys which are not used can be decreased. When the display is changed to the standard display area 9*a,* all of the original function keys can be displayed and used.

The screen of the LCD 9 and the magnification display area 9*b* are a rectangle in the landscape orientation. The standard display area 9*a* is a rectangle in the portrait orientation. When the standard display area 9*a* is switched to the magnification display area 9*b* to display the realistic image of the embroidery pattern by magnification, the posture of the pattern, which is being displayed in the portrait orientation, is rotated 90° so as to be displayed in the landscape orientation. The embroidery pattern, e.g. floral pattern, in the rectangle can be displayed in the portrait or landscape orientation respectively in accordance with the shape of the standard display area 9*a* or the magnification display area 9*b.* Thus, it is possible to magnify the whole embroidery pattern through the effective use of the display area.

Figure 11:
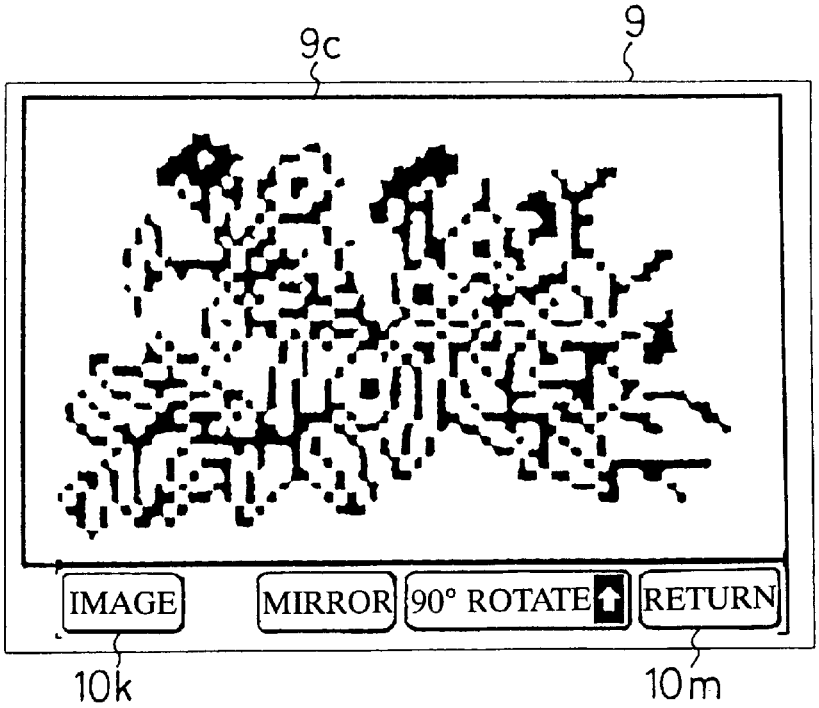
FIG. 11 corresponds to FIG. 9 when the display is changed to a magnification display according to another exemplary embodiment of the invention.

The following are modifications of the above embodiment:

At S25 in the flowchart of FIG. 5 in which the display area is changed, a magnification display area 9*c* shown in FIG. 11 may be used. The magnification display area 9*c* may be equipped with a part of function keys displayed on the edit screen on the right and bottom of the LCD 9.

When the magnification display area 9*c* is displayed in the subtotal area of the LCD 9 at S25 of the pattern selection control, the return key may not be displayed. The display may be arranged in such a manner that any operation using the touch keys 10 may be acceptable so as to return to the edit screen.

Instead of the LCD 9, a monochrome liquid crystal display may be provided.

The screen of the LCD 9 and the magnification display area 9*b* may be a rectangle in the portrait orientation, and the standard display area may be a rectangle in the landscape orientation. The position of the pattern being displayed may be rotated 90° when the display is changed from the standard display area 9*a* to the magnification display area 9*b*.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A display apparatus for a sewing machine, comprising:

a display device that displays a pattern and function keys on a display screen thereof;

a display controller that controls the display device to selectively display a first display area for displaying the pattern and functions keys and a second display area for displaying a magnified image of the pattern and at least one function key, the second display area being larger than the first display area, the second display area occupying an area that reduces the number of function keys which are displayed by the first display area; and a display switching device that switches the display on the display device between the first display area and the second display area.

2. The display apparatus according to claim 1, wherein the first display area is less than half of the display screen.

3. The display apparatus according to claim 1, wherein the second display area is approximately as large as the display screen.

4. The display apparatus according to claim 1, wherein the display device comprises a touch key panel and the display controller controls the display device to display at least one function key thereon.

5. The display apparatus according to claim 4, wherein the display screen outside of the first display area includes a predetermined number of function keys, and the second display area includes less than the predetermined number of function keys.

6. The display apparatus according to claim 4, wherein when the display on the display device is switched to the second display area, at least one key is displayed on the display screen outside of the second display area.

7. The display apparatus according to claim 1, wherein the first display area is placed in a first orientation on the display screen and the second display area is placed in a second orientation perpendicular to the first orientation when the display is switched between the first display area and the second display area and the pattern is rotated 90°.

8. The display apparatus according to claim 7, wherein the first orientation is a portrait orientation and the second orientation is a landscape orientation.

9. The display apparatus according to claim 1, further comprising a display data creating device that creates display data based on sewing data, wherein the second display area displays the magnified image of the pattern according to the display data created by the display data creating device.

10. The display apparatus according to claim 1, wherein the display device comprises a color display device.

11. A method for displaying patterns on a sewing machine display device, comprising:

displaying a pattern and function keys on a display screen of the display device;

controlling the display device to selectively display a first display area for displaying the pattern and function keys and a second display area for displaying a magnified image of the pattern and at least on function key, the second display area being larger than the first display area, the second display area occupying an area that reduces the number of function keys which are displayed by the first display area; and switching the display on the display device between the first display area and the second display area.

12. The method of claim 11, wherein the first display area is less than half of the display screen.

13. The method of claim 11, wherein the second display area is approximately as large as the display screen.

14. The method of claim 11, wherein the display device comprises a touch key panel and further comprising controlling the display device to display at least one function key thereon.

15. The method of claim 14, wherein the display screen outside of the first display area includes a predetermined number of function keys, and the second display area includes less than the predetermined number of function keys.

16. The method of claim 14, wherein when the display on the display device is switched to the second display area, at least one key is displayed on the display screen outside of the second display area.

17. The method of claim 11, wherein the first display area is placed in a first orientation on the display screen and the second display area is placed in a second orientation perpendicular to the first orientation when the display is switched between the first display area and the second display area and the pattern is rotated 90°.

18. The method of claim 17, wherein the first orientation is a portrait orientation and the second orientation is a landscape orientation.

19. The method of claim 11, further comprising creating display data based on sewing data, wherein the second display area displays the magnified image of the embroidery pattern according to the created display data.

20. The method of claim 11, wherein the display device comprises a color display device.

21. A memory medium containing routines for displaying patterns on a sewing machine display device, comprising:

a routine for displaying a pattern and function keys on a display screen of the display device;

a routine for controlling the display device to selectively display a first display area for displaying the pattern and function keys and a second display area for displaying a magnified image of the pattern and at least on function key, the second display area being larger than the first display area, the second display area occupying an area that reduces the number of function keys which are displayed by the first display area; and a routine for switching the display on the display device between the first display area and the second display area.

22. The memory medium of claim 21 wherein the first display area is less than half of the display screen.

23. The memory medium of claim 21, wherein the second display area is approximately as large as the display screen.

24. The memory medium of claim 21, wherein the display device comprises a touch key panel and further comprising controlling the display device to display at least one function key thereon.

25. The memory medium of claim 24, wherein the display screen outside of the first display area includes a predetermined number of function keys, and the second display area includes less than the predetermined number of function keys.

26. The memory medium of claim 24, wherein when the display on the display device is switched to the second display area, at least one key is displayed on the display screen outside of the second display area.

27. The memory medium of claim 21, wherein the first display area is placed in a first orientation on the display screen and the second display area is placed in a second orientation perpendicular to the first orientation when the display is switched between the first display area and the second display area and the embroidery pattern is rotated 90°.

28. The memory medium of claim 27, wherein the first orientation is a portrait orientation and the second orientation is a landscape orientation.

29. The memory medium of claim 21, further comprising a routine for creating display data based on sewing data, wherein the second display area displays the magnified image of the pattern according to the created display data.

30. The memory medium of claim 21, wherein the display device comprises a color display device.

* * * * *